US005353013A

United States Patent [19]

Estrada

[11] Patent Number: 5,353,013

[45] Date of Patent: Oct. 4, 1994

[54] VEHICLE OPERATOR SLEEP ALARM

[76] Inventor: Richard J. Estrada, 758 Arkansas St., San Francisco, Calif. 94107

[21] Appl. No.: 61,411

[22] Filed: May 13, 1993

[51] Int. Cl.[5] ..... G08B 21/00

[52] U.S. Cl. ..... 340/575; 180/272; 340/576

[58] Field of Search ..... 340/575, 576; 180/272

[56] References Cited

U.S. PATENT DOCUMENTS

| | | | |
|---|---|---|---|
| 2,724,109 | 11/1955 | Skolnick et al. | 340/575 |
| 2,754,497 | 7/1956 | Wolpert | 349/575 |
| 3,953,831 | 4/1976 | Estrada | 340/576 |
| 4,144,531 | 3/1979 | Ambergen | 340/575 |
| 4,555,697 | 11/1985 | Thackrey | 340/575 |
| 4,875,030 | 10/1989 | Chiu | 340/575 |
| 4,953,111 | 8/1990 | Yamamoto et al. | 340/575 |

*Primary Examiner*—Glen Swann
*Attorney, Agent, or Firm*—Graham & James

[57] ABSTRACT

An alarm system for warning a vehicle driver that he or she is falling asleep while driving includes an alarm module mounted in the cabin of the vehicle, preferably above the driver's seat. The module includes an optical beam emitter and receiver directed toward the head of the driver. A reflector is provided to be worn on the head of the driver, either on a hat, cap, headband, or the like. The optical emitter and receiver system is aimed and arranged so that head position associated with loss of wakefulness causes the alarm system to emit a loud warning which wakens the driver immediately. For example, the light beam of the system may be aimed slightly below the expected position of the reflector on the driver's head, so that no light from the optical emitter is reflected to the system receiver when the driver is awake. If the driver begins to doze and the head slumps forward, the reflector is moved into the emitter beam, reflecting light to the optical receiver and setting off the alarm. Alternatively, the optical beam of the system may be aimed toward the expected position of the reflector when the driver is awake, and the system is set to emit an alarm only when the reflected beam is no longer received, as when the driver's head nods forward or sideways upon falling asleep. The optical emitter and receiver preferably operate in a portion of the light spectrum beyond human vision, so that the detector system does not interfere with the driver's visual function. The alarm system of the invention may include a self-contained power supply, or may be connected to the vehicle electrical system.

14 Claims, 3 Drawing Sheets

VEHICLE OPERATOR SLEEP ALARM

BACKGROUND OF THE INVENTION

This invention generally relates to alarm systems for vehicles, and more particularly to a system for warning a vehicle operator that he or she is falling asleep while driving.

Among the many hazards associated with driving a vehicle, a driver falling asleep while operating a vehicle comprises a danger to the public as well as himself. Although this problem is commonly associated with truck drivers or bus drivers and the like who drive for long distances and long periods, any driver can fall victim to fatigue and the effects of hours of monotonous driving. Accordingly, there have been many attempts to devise an alarm system that will warn a driver of sustained inattention or sleep. However, no such system has become successful among professional or non-professional drivers.

Prior alarm systems for wanting a vehicle driver of dozing or sleeping generally have relied either on head position or head movement of the driver as an indication of attentiveness. These systems generally have included some type of detector mounted on the head of the driver, and an alarm annunciator either combined with the detector or mounted in the vehicle itself. In either case, the driver is required to wear some form of headgear that is unique to the alarm system, and which may be cumbersome, heavy, or otherwise irritating to the driver. In addition, if the alarm annunciator is mounted in the vehicle, the system generally requires some form of wired connection between the driver and the vehicle, further exacerbating the inconvenience to the driver.

SUMMARY OF THE INVENTION

The present invention generally comprises an alarm system for warning a driver of a vehicle that he or she is falling asleep while driving. A salient feature of the alarm system is that there is no bulky device worn by the driver, and no cable connection required to the vehicle.

The invention includes an alarm module mounted in the cabin of the vehicle, preferably above the driver's seat. The module includes an optical beam emitter and receiver directed toward the head of the driver. A reflector is provided to be worn on the head of the driver, either on a hat, cap, headband, or the like. The optical emitter and receiver system is aimed and arranged so that head position associated with loss of wakefulness causes the alarm system to emit a loud warning which wakens the driver immediately. For example, the light beam of the system may be aimed slightly below the expected position of the reflector on the driver's head, so that no light from the optical emitter is reflected to the system receiver when the driver is awake. If the driver begins to doze and the head slumps forward, the reflector is moved into the emitter beam, reflecting light to the optical receiver and setting off the alarm.

Alternatively, the optical beam of the system may be aimed toward the expected position of the reflector when the driver is awake, and the system is set to emit an alarm only when the reflected beam is no longer received, as when the driver's head nods forward or sideways upon falling asleep.

The optical emitter and receiver preferably operate in a portion of the light spectrum beyond human vision, so that the detector system does not interfere with the driver's visualization of the roadway and the surroundings. For example, infrared LED emitter-detector modular systems that are now commercially available could serve as the emitter and receiver of the invention. The alarm system of the invention may include a self-contained power supply, or may be connected to the vehicle electrical system.

DESCRIPTION OF THE PREFERRED EMBODIMENT

Figure 1:
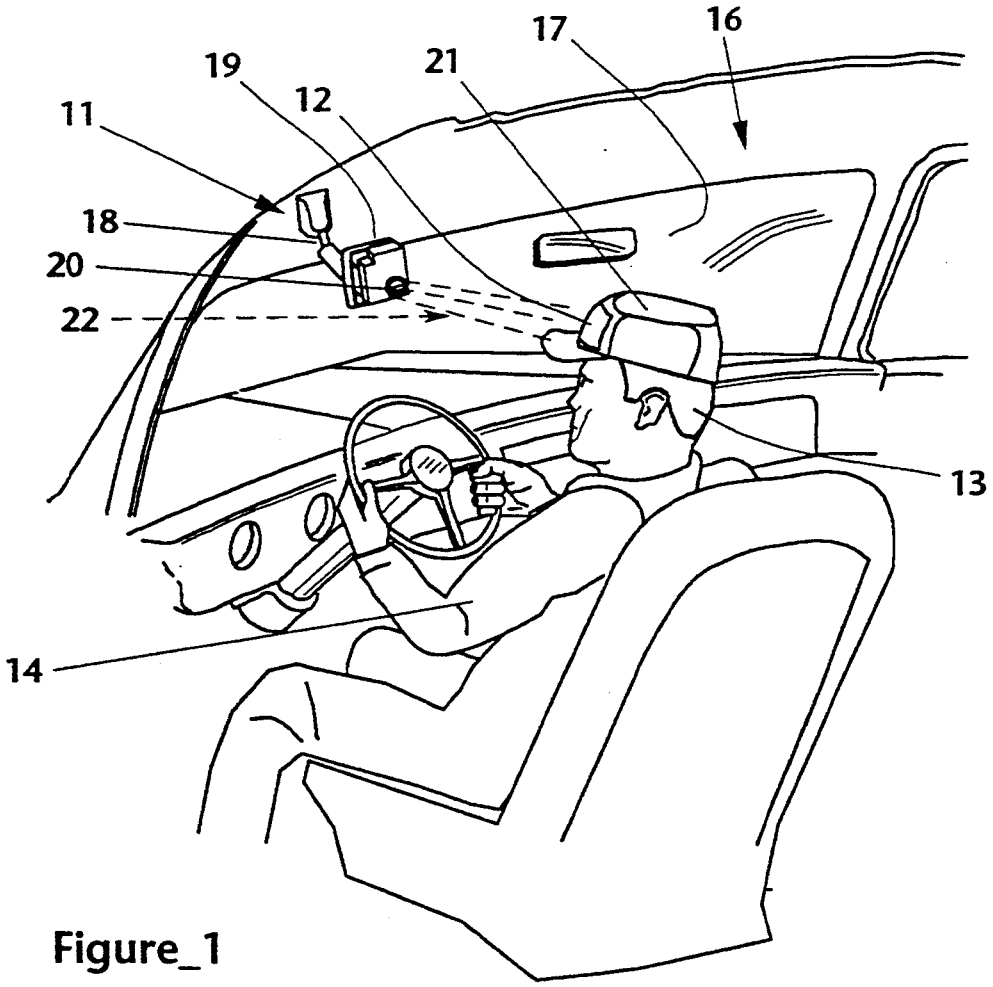
FIG. 1 is a perspective view of the vehicle operator sleep alarm system installed in a typical passenger vehicle.
Figure 3:
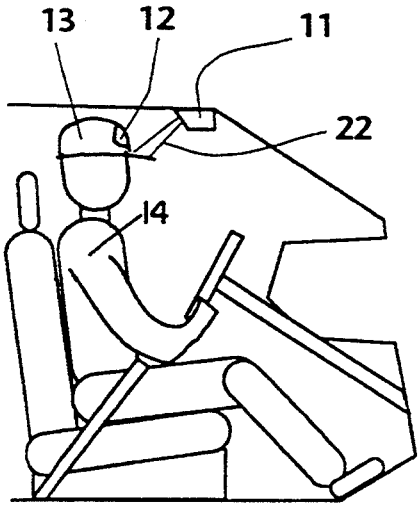
FIG. 3 is a schematic side view of the vehicle operator sleep alarm system installed in a typical passenger vehicle, with the driver awake.

The present invention generally comprises a light-activated alarm system for a vehicle to warn the driver that he or she is falling asleep while driving. With regard to FIG. 1, the system includes a module 11 adapted to be secured within the cabin 16 of a vehicle. The module includes a swivel mount 18 and a housing 19, and is preferably mounted above the windshield 17. The housing includes a sensor window 20 aimed toward the head 13 of the driver 14. The driver 14 is provided with a reflector 12 that is supported in a fixed position on the driver's head 13. The reflector 12 is formed of a flexible material that is an efficient, diffuse reflector of the wavelength employed by the system, as will be explained below. The reflector as depicted is attached to the front portion of the crown of a cap 21; it may likewise be secured to any other form of hat, headband, hood, bonnet, or the like. It is significant that the reflector is positioned so that when the vehicle operator 14 is seated in the driver's seat and facing toward the windshield with the head 13 in an upright, alert position, the reflector is disposed so that it is slightly above the output beam 22 of the sensor window 20. This situation is also depicted in FIG. 3.

Figure 4:
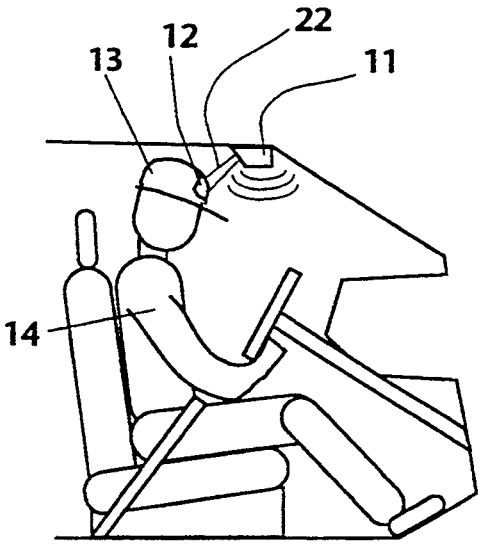
FIG. 4 is a schematic side view as in FIG. 3, with the driver asleep and the head nodding to set off the alarm system.

If the driver 14 should lose wakefulness and begin to doze, the head 13 will slump forward, as shown in FIG. 4, moving the reflector 12 into the beam 22 from the sensor window 20. The reflector 12 is a far more efficient reflector of the wavelength of the beam 22 than the hat 21 or the skin of the driver. Therefore, the reflector 12 will return a sufficient amount of the light from the beam 22 to the sensor window 20 to cause the module to emit an audio alarm warning. The driver will thus be immediately awakened, and the unsafe condition will be rectified.

Figure 5:
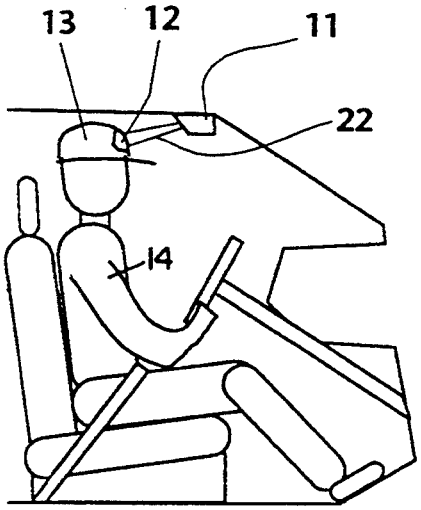
FIG. 5 is a schematic side view of the vehicle operator sleep alarm system installed in a typical vehicle and operating in an alternative mode, with the driver awake.
Figure 6:
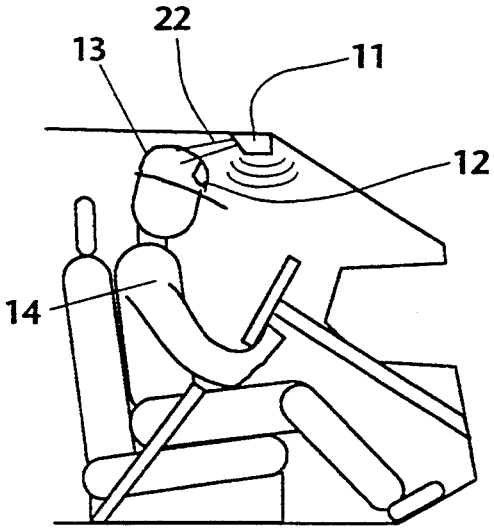
FIG. 6 is a schematic side view as in FIG. 5, with the drive asleep and the head nodding to set off the alarm system.

The operation of the invention as described above is the normally dark mode, in which the receiver is not illuminated unless a dangerous, driver asleep condition exists. With regard to FIG. 5, the invention may also be arranged to operate in a normally light mode in which the beam 22 is directed toward the reflector 12 when the driver is in an alert, erect posture, and the audio warning device is off. When the driver dozes and the head slumps, as shown in FIG. 6, the beam 22 no longer strikes the reflector 12, and the resulting decrease in the receiver signal triggers the audio warning device to sound. This latter embodiment has the advantage that the head slumping in any direction will trigger the alarm. Aiming the optical beam emitter to achieve the normally light or normally dark modes of operation may be accomplished by employing the swivel mount 18.

Figure 2:
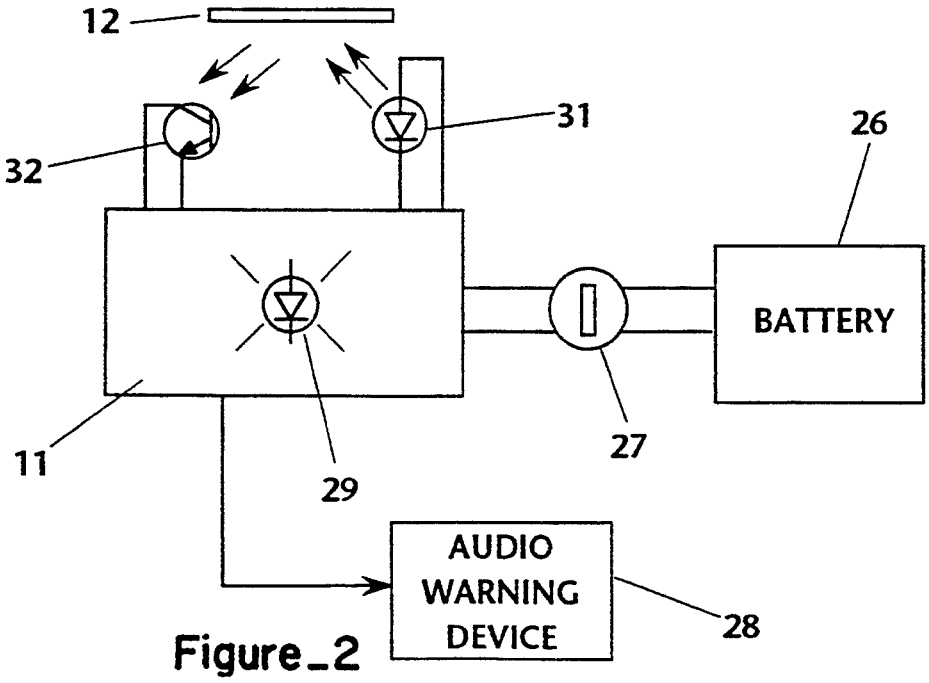
FIG. 2 is a functional block diagram depicting the electronic circuit of the alarm system.

With regard to FIG. 2, the module 11 may be connected to the battery 26 of the vehicle through the ignition switch 27, so that the system operates only when the vehicle engine is operating. The module includes an optical emitter 31 and an optical receiver 32, both directed through the sensor window 20 of the module. A detector circuit is connected to the receiver 32 and generates an alarm actuating signal when the receiver signal level exceeds a predetermined threshold. The alarm actuating signal is conducted to an external audio warning device 28, or the device 28 may be incorporated within the module itself. The audio warning device may comprise any appropriate audio alarm known in the prior art, such as a siren, bell, or shriek sound, or may include a recorded message. The module may include an indicator light 29, such as a visible LED, to indicate to the user that the system is switched on and functioning. In addition, the light beam emitter 31 may comprise an infrared LED equipped with a collimating lens, and the light receiver 32 may comprise a photodiode tuned to the wavelength of the LED emitter.

There are known in the prior art many forms of optical sensor devices employing paired LED light sources and photodiode receivers. Some of these devices modulate the output beam and demodulate the receiver signal, so that the chance of a false detection are greatly reduced. These systems are inexpensive and readily available. It is also within the scope of the invention to provide a module 11 that is entirely self-contained, including the battery, audio warning device, and on-off switch.

Figure 7:
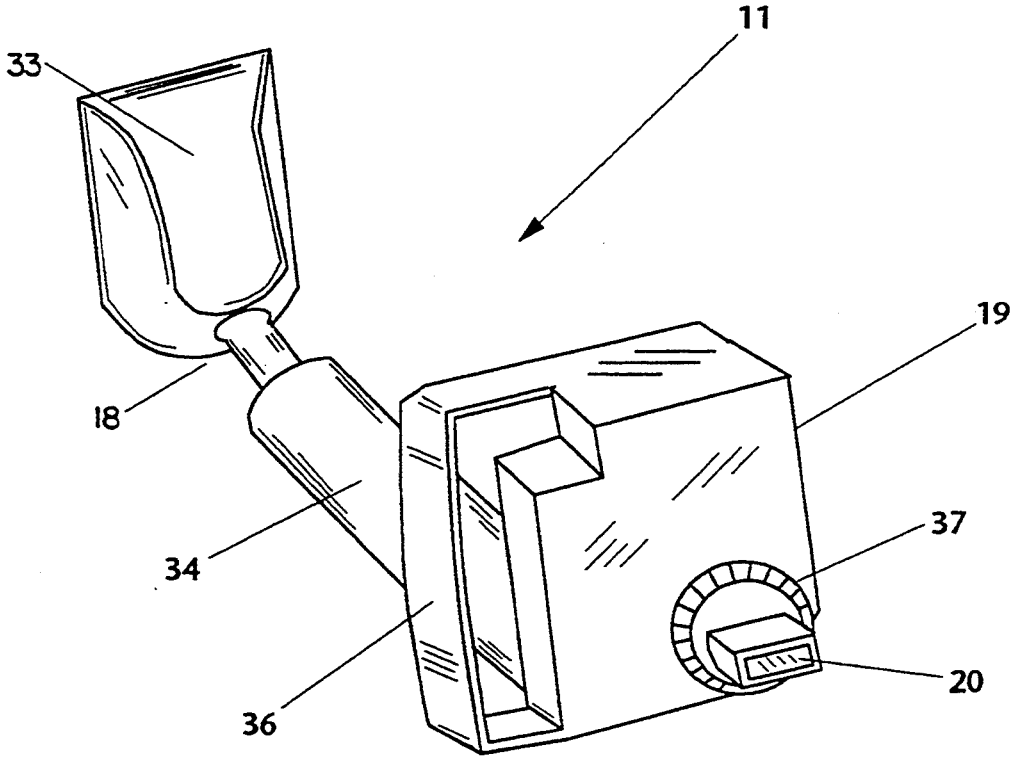
FIG. 7 is a perspective view of the vehicle operator sleep alarm module of the invention.

With regard to FIG. 7, the module 11 includes a mounting bracket 33 adapted to be secured to the interior surface of the vehicle cabin above the windshield. The swivel mount 18 extends from the bracket 33 to a support tube 34. The distal end of the tube 34 is joined to the housing 19, so that the angular orientation of the housing 19 may be selectively varied to aim the window 20 toward the target reflector 12. The housing 19 also includes an integral handle 36 extending from one side thereof, and an on-off switch button (not shown) may extend from the housing adjacent to the handle. A bezel mount 37 secures the window 20 to the housing 19 at the appropriate angle and orientation. Wiring connecting the module 11 to the vehicle electrical system may extend through the support tube 34 and swivel mount 18 (for original equipment installations), or may extend externally to the upper margin above the windshield and thence to the appropriate electrical connections.

I claim:

1. An alarm system for a vehicle, including;

light emitter means for generating a light beam;

optical receiver means for detecting reflected light from said light beam;

reflector means supported on the head of a driver of the vehicle to reflect said light beam, said reflector means being oriented to reflect said light beam toward said optical receiver when the head of the vehicle driver is in a position indicative of loss of wakefulness; and audio warning means responsive to a signal from said optical receiver means to generate an audio alarm signal to waken the driver.

2. The alarm system of claim 1, wherein said light emitter means operates at a predetermined wavelength, and said optical receiver means detects said predetermined wavelength.

3. The alarm system of claim 2, wherein said reflector means includes a reflective material that is optimally reflective at said predetermined wavelength.

4. The alarm system of claim 3, wherein said reflective material is incorporated into an article of clothing worn on the head of the driver.

5. The alarm system of claim 3, wherein said predetermined wavelength is within the infrared light spectrum.

6. The alarm system of claim 1, wherein said light emitter means and said optical receiver are secured within a common module, and further including means for securing said module within said vehicle with said light emitter and optical receiver directed toward the head of the vehicle driver.

7. The alarm system of claim 6, wherein said audio warning means is secured within said common module.

8. An alarm system for a vehicle, including;

reflector means supported on the head of a driver of the vehicle to reflect light of a predetermined wavelength, optical means operating at said predetermined wavelength to detect a position of the head of the driver that is indicative of loss of wakefulness and to generated an alarm actuating signal; and audio warning means responsive to said alarm actuating signal to generate an audio alarm signal to waken the driver.

9. The alarm system of claim 8, wherein said optical means includes light emitter means for directing a light beam toward said reflector means, and optical receiver means for detecting said light beam reflected from said reflector means.

10. The alarm system of claim 9, wherein said light beam illuminates said reflector means when the head of the driver is disposed in a position indicative of loss of wakefulness.

11. The alarm system of claim 9, wherein said light beam illuminates said reflector means when the head of the driver is disposed in a position indicative of wakefulness, and said optical means generates an alarm actuating signal when said receiver means fails to receive a light beam reflection from said reflector means.

12. The alarm system of claim 9, wherein said light emitter means and said optical receiver means are secured within a common housing, and further including adjustable angle mounting means for securing said common housing to an interior surface of the vehicle.

13. The alarm system of claim 12, wherein said adjustable angle mounting means includes a mounting bracket secured to said interior surface, and a swivel assembly secured between said mounting bracket and said common housing.

14. The alarm system of claim 8, wherein said reflector means includes a reflective material incorporated into an article of apparel warn on the head of the driver.

* * * * *